US011395070B2

(12) United States Patent
Nozaki

(10) Patent No.: US 11,395,070 B2
(45) Date of Patent: Jul. 19, 2022

(54) DIAPHRAGM AND ELECTROACOUSTIC TRANSDUCER INCLUDING THE DIAPHRAGM

(71) Applicant: YAMAHA CORPORATION, Hamamatsu (JP)

(72) Inventor: Akihiko Nozaki, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 13 days.

(21) Appl. No.: 16/829,392

(22) Filed: Mar. 25, 2020

(65) Prior Publication Data

US 2020/0228899 A1 Jul. 16, 2020

Related U.S. Application Data

(63) Continuation of application No. PCT/JP2018/041480, filed on Nov. 8, 2018.

(30) Foreign Application Priority Data

Nov. 24, 2017 (JP) ..... JP2017-225663

(51) Int. Cl.
*H04R 7/14* (2006.01)
*H04R 9/06* (2006.01)
*H04R 19/02* (2006.01)

(52) U.S. Cl.
CPC ..... *H04R 7/14* (2013.01); *H04R 9/06* (2013.01); *H04R 19/02* (2013.01)

(58) Field of Classification Search
CPC ... H04R 1/00; H04R 1/20; H04R 1/22; H04R 7/00; H04R 7/02; H04R 7/12;
(Continued)

(56) References Cited

U.S. PATENT DOCUMENTS 4,132,872 A * 1/1979 Inoue ..... H04R 7/14 181/165
4,205,205 A 5/1980 Babb
(Continued)

FOREIGN PATENT DOCUMENTS

JP 55149596 A * 11/1980 ..... H04R 7/14
JP H08168092 A 6/1996
(Continued)

OTHER PUBLICATIONS

International Search Report issued in Intl. Appln. No. PCT/JP2018/041480 dated Jan. 29, 2019. English translation provided.
(Continued)

*Primary Examiner* — Walter F Briney, III
(74) *Attorney, Agent, or Firm* — Rossi, Kimms & McDowell LLP

(57) ABSTRACT

A diaphragm for a speaker includes; a diaphragm body configured to provide different stiffness along different directions extending from a center of the diaphragm body to a periphery of the diaphragm body, with a largest stiffness value provided along a first direction extending between the center and the periphery of the diaphragm body; and a protector including a first rib extending in one of the first direction or a second direction, where the stiffness is less than the largest stiffness value, intersecting the first direction.

9 Claims, 7 Drawing Sheets

(58) Field of Classification Search
CPC ..... H04R 7/122; H04R 7/14; H04R 2207/00; H04R 2207/021; H04R 9/00; H04R 9/02; H04R 9/06; H04R 2209/00
See application file for complete search history.

(56) References Cited

U.S. PATENT DOCUMENTS

| | | | | |
|---|---|---|---|---|
| 9,628,917 | B2 * | 4/2017 | Pircaro | H04R 7/06 |
| 10,142,736 | B2 * | 11/2018 | Noro | H04R 7/122 |
| 10,244,322 | B2 * | 3/2019 | Geva | H04R 7/26 |
| 2002/0061117 | A1 * | 5/2002 | Takewa | H04R 31/003 381/430 |
| 2007/0053547 | A1 * | 3/2007 | Ando | H04R 9/06 381/430 |
| 2009/0060251 | A1 * | 3/2009 | Maeda | H04R 7/02 381/398 |
| 2012/0321124 | A1 * | 12/2012 | Chen | H04R 7/122 381/423 |
| 2017/0201834 | A1 * | 7/2017 | Nozaki | H04R 9/06 |
| 2018/0352336 | A1 * | 12/2018 | Yamagami | H04R 9/025 |
| 2020/0045412 | A1 * | 2/2020 | Wu | H04R 1/023 |

FOREIGN PATENT DOCUMENTS

| | | | |
|---|---|---|---|
| JP | 2008103856 | A | 5/2008 |
| JP | 2009267875 | A | 11/2009 |
| JP | 2015170881 | A | 9/2015 |
| JP | 2016072955 | A | 5/2016 |

OTHER PUBLICATIONS

Written Opinion issued in Intl. Appln. No. PCT/JP2018/041480 dated Jan. 29, 2019. English translation provided.
International Preliminary Report on Patentability issued in Intl. Appln. No. PCT/JP2018/041480 dated Jun. 4, 2020. English translation provided.

* cited by examiner

DIAPHRAGM AND ELECTROACOUSTIC TRANSDUCER INCLUDING THE DIAPHRAGM

CROSS REFERENCE TO RELATED APPLICATION

The present application is a continuation application of International Application No. PCT/JP2018/041480, filed on Nov. 8, 2018, which claims priority to Japanese Patent Application No. 2017-225663, filed on Nov. 24, 2017. The contents of these applications are incorporated herein by in their entirety.

BACKGROUND

The following disclosure relates to an electroacoustic transducer configured to perform conversion between vibration of a device, such as a microphone unit and a speaker, and an electric signal, and relates to a diaphragm of the electroacoustic transducer.

Patent Document 1 (Japanese Patent Application Publication No. 2016-72955) discloses a technique in which, in order to achieve wide directivity at the middle and high frequencies, a groove is formed in a central cap of a riffell speaker using a diaphragm in which a pair of longitudinal split tubular surfaces are formed side by side, and a valley is formed between a side portion of one of the longitudinal split tubular surfaces and a side portion of the other, and the groove extends in a direction in which the valley extends. It is noted that the central cap of the speaker serves as a protector for preventing ingress of foreign matters such as dust into an electroacoustic transducer (hereinafter may be referred to simply as "transducer" including a voice coil. Thus, the central cap may be called a center cap or a dust cap.

Patent Document 2 (Japanese Patent Application Publication No. 2008-103856) discloses a technique in which a reinforcing piece extending in a radial direction of a diaphragm of a speaker is provided at a boundary between the diaphragm and a dust cap to reduce excessive deformation of the diaphragm to flatten sound-pressure frequency characteristics of the speaker.

Patent Document 3 (Japanese Patent Application Publication No. 2009-267875) discloses a technique in which a dust cap of a track-type speaker has a V-shape to reinforce the dust cap to flatten sound-pressure frequency characteristics and reduce harmonic distortion.

SUMMARY

In riffell speakers, the stiffness of a diaphragm is different in a direction directed from the center toward a periphery of the diaphragm. Thus, when the diaphragm is vibrated at a particular frequency, divided vibration in a particular vibrating mode easily occurs, so that a voice coil is deformed by an excessive load imposed thereon. The magnetic characteristics of the transducer vary due to this deformation of the voice coil, easily causing harmonic distortion, unfortunately. The diaphragm and the dust cap disclosed in Patent Document 1 are for improving the directivity at the middle and high frequencies, and Patent Document 1 does not disclose the above-described harmonic distortion. The reinforcing piece disclosed in Patent Document 2 is disposed so as to serve as a bridge between a peripheral portion of the center cap and a cone to reduce deformation of the cone. This reinforcing piece however does not increase the strength of the center cap and does not reduce deformation of a bobbin for the voice coil. Also, the reinforcing piece does not reinforce the entire center cap or the entire cone, and accordingly it is considered that the effect of the reinforcement is limited. The technique disclosed in Patent Document 3 is of narrow application, unfortunately. This is because the technique disclosed in Patent Document 3 is based on a premise that the speaker includes a voice coil of a track type, and the technique cannot be applied to a speaker including a voice coil of a round shape. In addition, the technique disclosed in Patent Document 3 has the following problem: since a substantially V-shaped fitting portion of the dust cap disclosed in Patent Document 3 is fitted in an inner space of the bobbin and bonded to the bobbin, the bobbin and the dust cap are secured to each other only at line-shaped portions of opposite ends of the fitting portion which are bonded to the bobbin, resulting in low stability of assembling and low durability in use. Furthermore, a second dust cap is additionally required to prevent exposure of the voice coil in the construction disclosed in Patent Document 3.

Accordingly, an aspect of the disclosure relates to a technique of reducing harmonic distortion in an electroacoustic transducer including a diaphragm with stiffness different in a direction directed from a center toward a periphery of the diaphragm.

In one aspect of the disclosure, a diaphragm for a speaker includes: a diaphragm body configured to provide different stiffness along different directions extending from a center of the diaphragm body to a periphery of the diaphragm body, with a largest stiffness value provided along a first direction extending between the center and the periphery of the diaphragm body; and a protector including a first rib extending in one of the first direction or a second direction, where the stiffness is less than the largest stiffness value, intersecting the first direction.

In another aspect of the disclosure, an electroacoustic transducer includes: a coil; and a diaphragm including: a diaphragm body configured to provide different stiffness along different directions extending from a center of the diaphragm body to a periphery of the diaphragm body, with a largest stiffness value provided along a first direction extending between the center and the periphery of the diaphragm body; and a protector provided with a rib extending in one of the first direction or a second direction, where the stiffness is less than the largest stiffness value, intersecting the first direction.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENT

Figure 1:
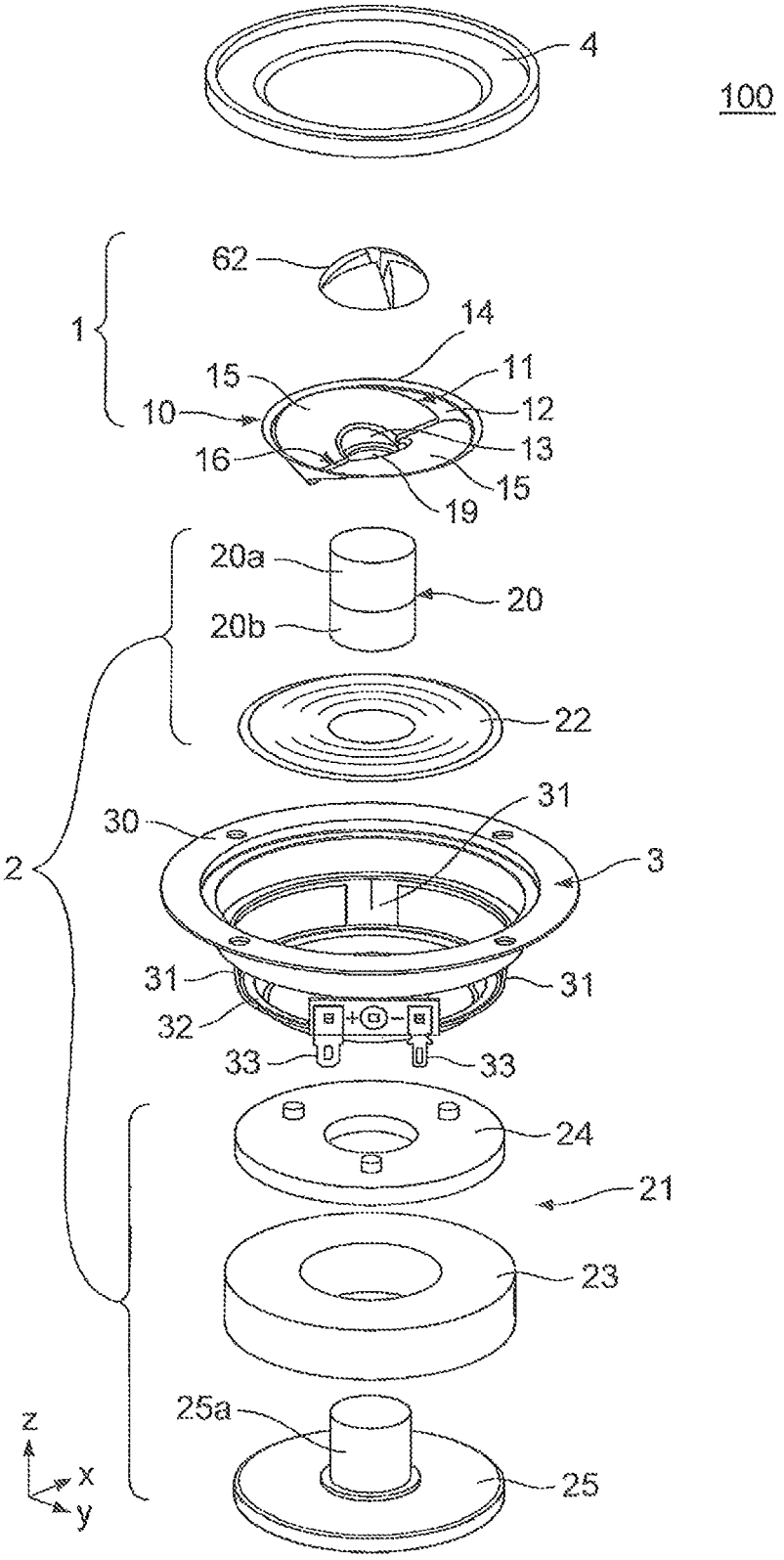
FIG. 1 is an exploded perspective view of a configuration of a speaker 100 according to one embodiment of an electroacoustic transducer.

Hereinafter, there will be described an embodiment with reference to drawings. FIGS. 1-6 illustrate a speaker 100 using a diaphragm according to one embodiment of an electroacoustic transducer. The speaker 100 according to the embodiment includes: a diaphragm 1; an actuator 2 for reciprocating the diaphragm 1; a support frame 3 for supporting the diaphragm 1 and the actuator 2; and an edge member 4 for supporting the diaphragm 1 such that the diaphragm 1 is reciprocable relative to the support frame 3. In the state illustrated in FIGS. 1 and 2, the up and down direction is defined such that the upper side is a side on which the edge member 4 is provided, and the lower side is a side on which the actuator 2 is provided. The direction in which a valley of the diaphragm 1 (a diaphragm body 10, more precisely), which will be described below, extends is defined as the front and rear direction (as one example of a first direction). The direction orthogonal to this direction is defined as the right and left direction (as one example of a second direction). Surfaces facing upward may be referred to as front surfaces, and surfaces facing downward as back surfaces. As illustrated in the drawings, the front and rear direction, the right and left direction, and the up and down direction may be hereinafter referred to as "x direction", "y direction", and "z direction", respectively. The x direction is another example of the first direction, the y direction is another example of the second direction, and the z direction is one example of the depth direction of the valley.

The diaphragm 1 includes the diaphragm body 10 and a dust cap 62 (see FIG. 1). As illustrated in the enlarged views in FIGS. 4 and 5, the diaphragm body 10 includes: a wing-pair portion 11; an end plate 12 that closes opposite ends of the valley 16 (which will be described below) of the wing-pair portion 11; a tubular portion 13 secured to a back portion of the wing-pair portion 11; and a ring plate 14 for connection of the diaphragm 1 to the edge member 4. These components are formed as a single component. The wing-pair portion 11 includes: a pair of longitudinal split tubular surfaces 15 arranged side by side; and the valley 16 defined between side portions of the respective longitudinal split tubular surfaces 15. Each of the longitudinal split tubular surfaces 15 is shaped by splitting and cutting a portion of a surface of a tube in its longitudinal direction (along its axial direction). The above-described side portions of the longitudinal split tubular surfaces 15 are side portions in a direction in which the tubular surfaces are curved.

Each of the longitudinal split tubular surfaces 15 may not be a single arc surface. For example, each of the longitudinal split tubular surfaces 15 may have a continuous series of curvatures. Also, the cross section of the longitudinal split tubular surface 15 along its circumferential direction (the right and left direction) may have a curvature that changes constantly or continuously like a parabola and a spline curve. Also, the longitudinal split tubular surface 15 may be shaped like a surface of a polygonal tube or stepped so as to have a plurality of steps, for example. The longitudinal split tubular surface 15 at least needs to be curved in one direction (the right and left direction coinciding with the circumferential direction of the longitudinal split tubular surface 15) such that the longitudinal split tubular surface 15 extends straight in a direction orthogonal to the one direction (the longitudinal direction of the longitudinal split tubular surface 15). It is noted that, as illustrated in FIG. 5, the shape of the longitudinal split tubular surface 15 on the zy plane may be a shape protruding upward with continuous curvatures.

Figure 5:
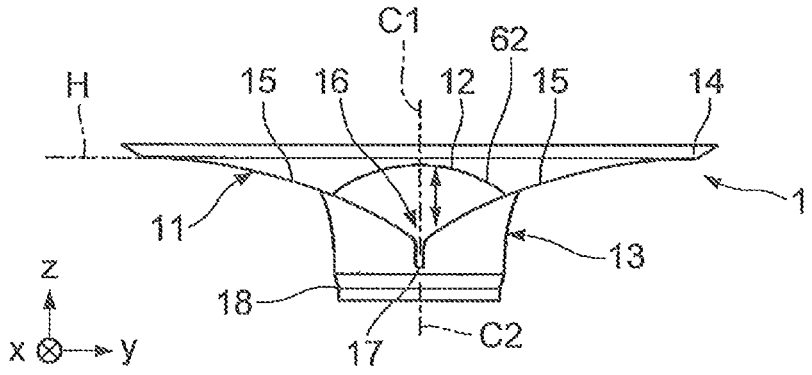
FIG. 5 is a cross-sectional view of the diaphragm body 10, taken along line V-V in FIG. 4.

As illustrated in FIG. 5, the longitudinal split tubular surfaces 15 are arranged side by side so as to each protrude in its front surface direction. The adjacent side portions are opposed to each other with a small space therebetween so as to have a U-shape in cross section along the circumferential direction of the longitudinal split tubular surface 15. Lower ends of the respective side portions are joined to each other so as to form a coupled portion 17 extending straight.

Figure 4:
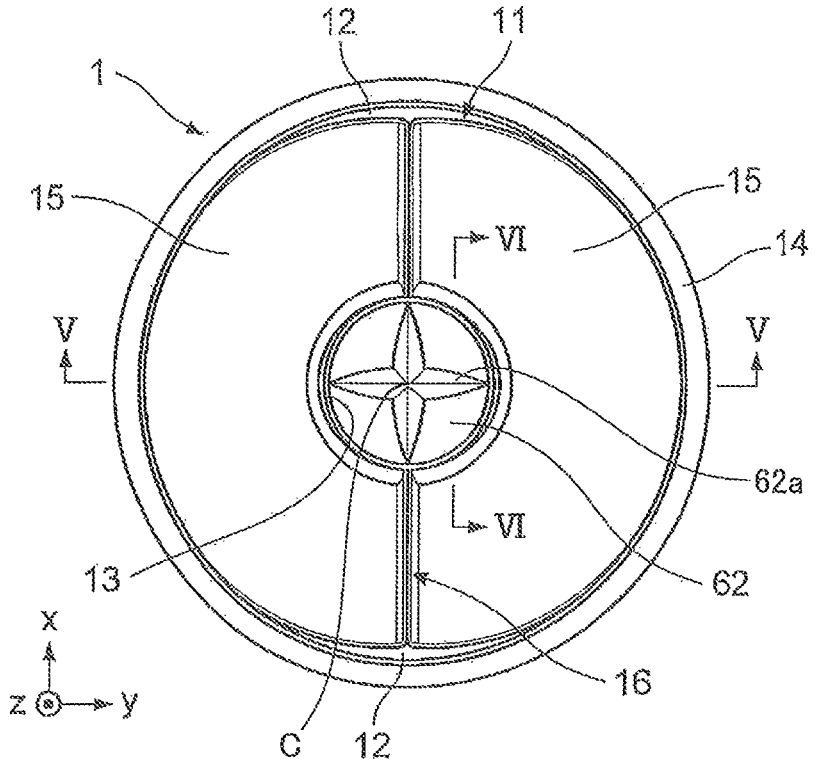
FIG. 4 is a front elevational view of a diaphragm body 10 of the speaker 100.

As illustrated in FIG. 4, an outer circumferential edge of the wing-pair portion 11 is substantially shaped like a circle in elevational view, but this circular shape is not a perfect circle. Specifically, the outer circumferential edge of the wing-pair portion 11 is formed such that the distance between the opposite ends of the valley 16 is slightly shorter than the longest distance between two positions of the outer circumferential edge in a direction orthogonal to the valley 16 (the longest distance of the wing-pair portion 11 along the right and left direction of the sheet surface in FIG. 4). In other words, the distance in the direction orthogonal to the valley 16 is the longest on the outer circumferential edge of the wing-pair portion 11, and each of the opposite ends of the valley 16 is located on a slightly inner side of the circle, whose outside diameter is equal to the longest distance, in the radial direction of the circle in elevational view. The axis extending through the center of the circle of the wing-pair portion 11 in elevational view is defined as an axis C1 of the wing-pair portion 11 (see FIG. 5). Here, since the center of the diaphragm body 10 is located at the position of the center of the circle of the wing-pair portion 11 in elevational view, the axis C1 extends through the center of the diaphragm body 10. The center of the diaphragm body 10 is located at a position equidistant from the opposite ends of the valley 16 in elevational view of the diaphragm body 10, and the axis C1 also extends through this position.

An outer circumferential edge of the end plate 12 is shaped like a circle whose longest diameter is equal to the distance between two positions on the outer circumferential edge of the end plate 12 in the direction orthogonal to the valley 16 of the wing-pair portion 11. Also, the end plate 12 extends from its outer circumferential edge to the opposite ends of the valley 16 of the wing-pair portion 11 in a circular-conical-surface shape to close the opposite ends of the valley 16. In other words, the end plate 12 shaped to partly constitute a circular conical surface is formed so as to close openings formed at the opposite ends of the valley 16 in order to define a circular outer-circumferential shape of the wing-pair portion 11 having the valley 16 formed by the side-by-side arrangement of the longitudinal split tubular surfaces 15. The ring plate 14 is connected to outer surfaces of the wing-pair portion 11 and the end plate 12 around them along the outer circumferential edges of the wing-pair portion 11 and the end plate 12. The ring plate 14 has a circular-conical-surface shape.

The tubular portion 13 is provided in the middle of the valley 16 in a direction in which the valley 16 extends, and a through hole 19 is formed in the wing-pair portion 11 (see FIG. 1). The tubular portion 13 has a tubular shape extending in the depth direction of the valley 16 (see FIG. 3). The tubular portion 13 is joined to an upper end portion of a voice coil 20 so as to couple the wing-pair portion 11 and the voice coil 20 to each other (see FIG. 3). The tubular portion 13 is disposed in a state in which an axis C2 (see FIG. 5) extending through the center of the tubular portion coincides with the axis C1 of the wing-pair portion 11. The tubular portion 13 has a tapered tubular shape whose diameter gradually decreases from an upper end to a lower end of the tubular portion 13. The tubular portion 13 extends to a position below a lower end of the coupled portion 17 of the wing-pair portion 11. A straight tubular portion 18 having the constant diameter is integrally formed at a lower end portion of the tubular portion 13. A bobbin 20*a* for the voice coil 20, which will be described below, is joined to the straight tubular portion 18 with, e.g., adhesive, such that an upper end of the bobbin 20*a* protrudes slightly from the straight tubular portion 18.

Since the diaphragm body 10 is constructed as described above, the stiffness of the diaphragm body 10 in the first direction (the direction in which the valley 16 extends) which is one of the directions directed from the center to the periphery of the diaphragm body 10 is different from the stiffness of the diaphragm body 10 in the second direction which is orthogonal to the first direction and which is another of the directions directed from the center to the periphery of the diaphragm body 10. Specifically, the stiffness of the diaphragm body 10 in the second direction is less than that of the diaphragm body 10 in the first direction, and the diaphragm body 10 is deformed more easily in the second direction than in the first direction. It is noted that the material of the diaphragm body 10 is not limited, and the diaphragm body 10 may be formed of any material generally used for the diaphragm of the speaker, such as synthetic resin, paper, and metal. For example, the diaphragm body 10 can be formed relatively easily by vacuum forming of a film formed of synthetic resin such as polypropylene and polyester, or injection molding of synthetic resin.

Figure 2:
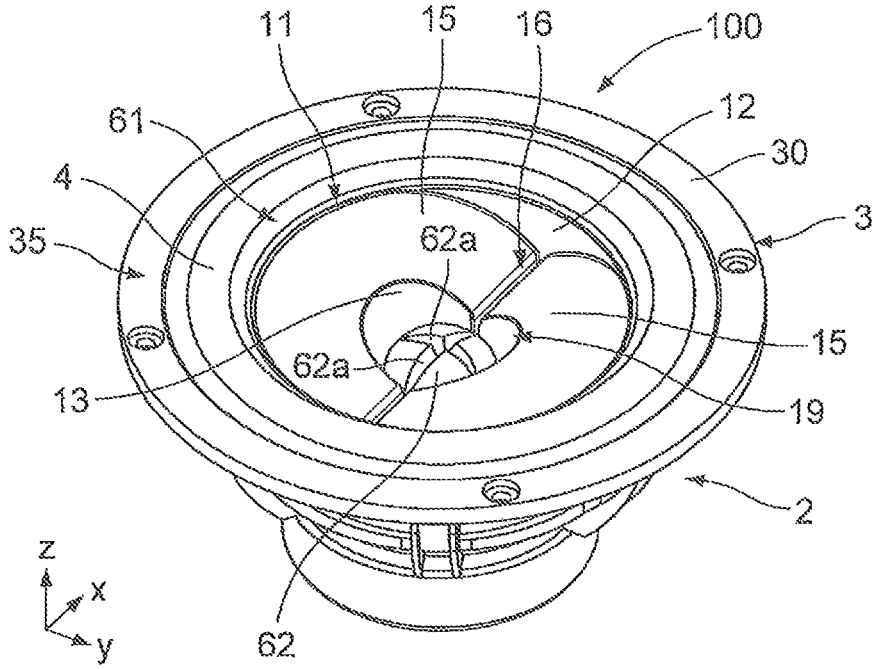
FIG. 2 is a perspective view of the speaker 100 in its assembled state.
Figure 6:
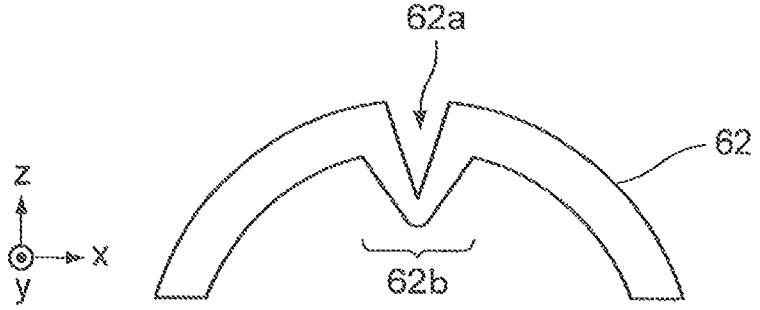
FIG. 6 is a cross-sectional view of the dust cap 62, taken along line VI-VI in FIG. 4.

The dust cap 62 is a substantially-flat dome-shaped member having substantially the same diameter as that of the through hole 19. The dust cap 62 is joined to a periphery of an upper end of the voice coil 20 so as to close the through hole 19. The diaphragm body 10 is bonded to an outer end portion of the dust cap 62. That is, in the present embodiment, the diaphragm body 10, the dust cap 62, and the voice coil 20 are coupled to each other in one piece as in common speakers. The dust cap 62 is a protector that protects the actuator 2 from ingress of foreign matters (e.g., dust) through the through hole 19. As illustrated in FIGS. 1, 2, and 4, a surface of the dust cap 62 has two grooves 62*a* orthogonal to each other and each extending in a corresponding one of the diameter directions of the dust cap 62. It is noted that FIG. 5 omits illustration of the grooves 62*a* for simplicity. FIG. 6 is a cross-sectional view of the dust cap 62, taken along line VI-VI in FIG. 4. As illustrated in FIG. 6, ribs 62*b* are formed on a back surface of the dust cap 62 so as to each extend along a corresponding one of the grooves 62*a* across the dust cap 62 in the corresponding diameter direction. That is, the two ribs 62*b* each extending in the corresponding diameter direction are formed on the back surface of the dust cap 62 so as to be orthogonal to each other. The two ribs 62*b* include the rib 62*b* (as one example of a second rib) extending in the right and left direction (i.e., the y direction), and the rib 62*b* (as one example of a first rib) extending in the front and rear direction (i.e., the x direction) when the dust cap 62 is seen in elevational view. The dust cap 62 is coupled to the center of the diaphragm body 10 (specifically, the upper end of the voice coil 20 protruding slightly from the straight tubular portion 18) such that one of the two grooves 62*a* extends in the direction in which the valley 16 extends (i.e., the x direction), and the other extends in the direction orthogonal to the direction in which the valley 16 extends (i.e., the y direction). Likewise, the dust cap 62 is coupled to the center of the diaphragm body 10 such that the one of the two ribs 62*b* (as the one example of the first rib) extends in the direction in which the valley 16 extends, and the other of the two ribs 62*b* (as the one example of the second rib) extends in the direction orthogonal to the direction in which the valley 16 extends when the dust cap 62 is seen in elevation view. The reason for providing the grooves 62*a* and the ribs 62*b* in and on the dust cap 62 and the reason for coupling the dust cap 62 to the diaphragm body 10 such that the one of the two grooves 62*a* extends in the direction in which the valley 16 extends, and the other extends in the direction orthogonal to the direction in which the valley 16 extends will be described later. When the dust cap 62 is seen in elevational view, the direction in which the rib 62*b* extending in the right and left direction extends and the direction in which the valley 16 extends may be substantially orthogonal to each other, and the direction in which the rib 62*b* extending in the front and rear direction extends and the direction in which the valley 16 extends may be substantially parallel with each other. The dust cap 62 is bonded to the diaphragm body 10 such that each of the axis C1 of the wing-pair portion 11 and the axis C2 of the tubular portion 13 extends through the center C of the dust cap 62 (as one example of a first position). Here, as illustrated in FIG. 4, the center C of the dust cap 62 is located at the center of a circle forming the outer shape of the dome shape when the dust cap 62 is seen in elevational view. In elevational view of the dust cap 62, one of the two ribs 62*b* extends through the center C of the dust cap 62 in the right and left direction, and the other of the two ribs 62*b* extends through the center C of the dust cap 62 in the front and rear direction.

The material of the dust cap 62 is not limited, and the dust cap 62 may be formed of a material generally used for the diaphragm of the speaker, such as synthetic resin, paper, and metal. For example, the dust cap 62 can be formed relatively easily by vacuum forming of a film formed of synthetic resin such as polypropylene and polyester, or injection molding of synthetic resin.

Figure 3:
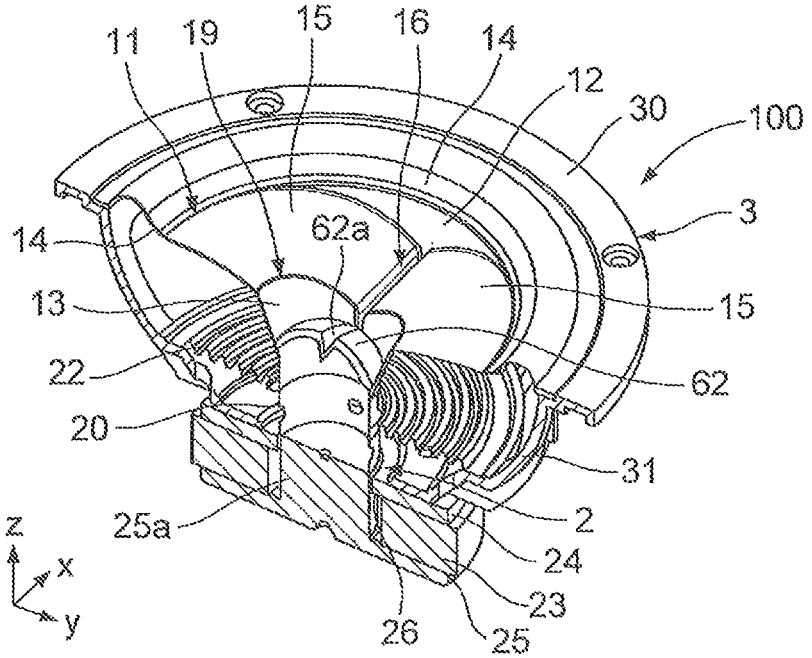
FIG. 3 is a half cross-sectional perspective view of the speaker 100 in its assembled state.

The actuator 2 is a voice-coil motor that vibrates the diaphragm 1 in accordance with a drive current supplied from an external device. That is, the actuator 2 is a transducer that performs conversion between vibration of the diaphragm 1 and an electric signal in the speaker 100. The actuator 2 includes; the voice coil 20 bonded to the tubular portion 13 provided at the back portion of the diaphragm body 10; and a magnet mechanism 21 fixed to the support frame 3. As illustrated in FIG. 1, the voice coil 20 is a round voice coil including a coil 20*b* wound around the cylindrical bobbin 20*a*. As illustrated in FIG. 3, an upper end portion of the voice coil 20 is fitted in and fixed to the straight tubular portion 18 of the tubular portion 13 secured to the back portion of the wing-pair portion 11 such that the upper end portion of the voice coil 20 slightly protrudes from the straight tubular portion 18 of the tubular portion 13. The dust cap 62 is coupled to the upper end portion. An outer circumferential portion of the voice coil 20 is supported by the support frame 3, with a damper 22 disposed therebetween. The voice coil 20 is reciprocable with respect to the support frame 3 in the axial direction of the voice coil 20. The damper 22 may be formed of a material which is used for the typical dynamic speaker.

The magnet mechanism 21 includes an annular magnet 23, a ring-shaped outer yoke 24 secured to one of opposite poles of the magnet 23, and an inner yoke 25 secured to the other of the opposite poles of the magnet 23. A distal end portion of a pole 25*a* standing on a center of the inner yoke 25 is disposed in the outer yoke 24, whereby an annular magnetic gap 26 is formed between the outer yoke 24 and the inner yoke 25, and an end portion of the voice coil 20 (a portion thereof at which the coil 20*b* is wound) is disposed in the magnetic gap 26.

The support frame 3 is formed of metal, for example. In the illustrated example, the support frame 3 includes; a flange portion 30 shaped like a circular frame; a plurality of arm portions 31 extending downward from the flange portion 30; and an annular frame portion 32 formed on lower ends of the respective arm portions 31. The diaphragm body 10 is disposed in a space formed inside the flange portion 30, with the coupled portion 17 points downward. The ring plate 14 of the diaphragm body 10 is bonded to an inner circumferential portion of the edge member 4. The diaphragm body 10 is supported by the upper surface of the flange portion 30 via the edge member 4. Thus, the edge member 4 has a round ring shape corresponding to the ring plate 14 of the diaphragm body 10. This edge member 4 can be formed of a material which is used for the typical dynamic speaker.

In the speaker 100 according to the present embodiment, a supporter 35 that supports the diaphragm body 10 so as to permit the vibration of the diaphragm body 10 in the direction of the vibration (the z direction coinciding with the depth direction of the valley 16) is constituted by the support frame 3 and the edge member 4. Also, the outer yoke 24 of the magnet mechanism 21 is mounted on the annular frame portion 32 of the support frame 3, whereby the magnet mechanism 21 and the support frame 3 are secured to each other as a single component.

In a state in which the diaphragm body 10 is mounted on the support frame 3, as illustrated in FIG. 5, in the case where a boundary line H (see the one-dot chain line in FIG. 5) is a line connecting between outermost ends of the respective longitudinal split tubular surfaces 15 (at positions at which the distance from the valley 16 is the longest) in their respective curving directions, each of the longitudinal split tubular surfaces 15 is curved in such a direction that a distance between the longitudinal split tubular surface 15 and the boundary line H increases with increase in distance from the distal end of the longitudinal split tubular surface 15 toward the valley 16, in cross section along the circumferential directions (the right and left direction) of the respective longitudinal split tubular surfaces 15 opposed to each other, with the valley 16 interposed therebetween.

As described above, the longitudinal split tubular surface 15 is not limited to a single arc surface and may be a surface having a continuous series of curvatures, a surface whose cross section has a curvature which changes continuously or constantly like a parabola and a spline curve, a surface shaped like a surface of a polygonal tube, and a surface having a plurality of step portions, but the longitudinal split tubular surfaces 15 are preferably shaped so as not to project from the boundary line H connecting between the distal ends of the respective longitudinal split tubular surfaces 15. It is noted that the reference numeral 33 in FIG. 1 denotes a terminal for connecting the voice coil 20 to external devices.

In the speaker 100 constructed as described above, when a drive current based on a voice signal is supplied to the voice coil 20 of the actuator 2 secured to the diaphragm body 10, a driving force generated based on the drive current is applied to the voice coil 20 by a change in magnetic flux generated by the drive current and a magnetic field in the magnetic gap 26, and the voice coil 20 is vibrated in a direction orthogonal to the magnetic field (i.e., the axial direction of the voice coil 20 and the z direction coinciding with the up and down direction indicated by the arrow in FIG. 5). This vibration causes the diaphragm body 10 connected to the voice coil 20 to be vibrated along the axial direction of the valley 16 to radiate reproduced sounds from the front surface of the diaphragm body 10.

In the diaphragm body 10, the wing-pair portion 11 forms the most area of the diaphragm body 10, and the end plate 12 is provided on a limited narrow area near the opposite ends of the valley 16. With this construction, sounds radiated from the longitudinal split tubular surfaces 15 of the wing-pair portion 11 which constitutes the most portion of the diaphragm body 10 are dominant as sounds radiated from the speaker 100. Accordingly, it is possible to achieve a wide directivity over middle and high frequencies like membranes used for riffell speakers.

Furthermore, the diaphragm body 10 is supported on the support frame 3 by means of the edge member 4 so as to permit reciprocating vibration of an outer circumferential portion of the diaphragm body 10 in the depth direction of the valley 16. Thus, the entire diaphragm 1 from the coupled portion 17 to the outer circumferential portion is uniformly vibrated by the actuator 2, in other words, the diaphragm body 10 is vibrated by what is called piston motion. Accordingly, the diaphragm body provides a high sound pressure also at low frequencies like conventional dynamic speakers. If the opposite ends of the valley 16 are open, a sound wave radiated from the diaphragm partly passes through the openings toward the back side of the diaphragm. In this embodiment, however, the opposite ends of the valley 16 are closed by the end plate 12, preventing the sound wave from going toward the back side of the diaphragm body 10, whereby the diaphragm body 10 can efficiently emit sounds from the entire front surface of the diaphragm body 10. Accordingly, the speaker 100 according to the present embodiment can achieve wide directivity over the full range of audible frequencies including the low frequencies and the middle and high frequencies.

In the speaker 100 constructed as described above, the tubular portion 13 is provided on the back portion of the diaphragm body 10, and this tubular portion 13 has the tubular shape so as to permit the upper end portion of the voice coil 20 of the actuator 2 to be fitted in and joined to the lower end portion of the tubular portion 13. Thus, even though the diaphragm body 10 includes the wing-pair portion 11 having the longitudinal split tubular surfaces 15 joined to each other at the coupled portion 17 extending straight, like common dynamic speakers, it is possible to join the diaphragm body 10 to the voice coil 20 having the cylindrical shape throughout the entire length of the voice coil 20 in its circumferential direction. Accordingly, the diaphragm body 10 and the voice coil 20 are firmly connected to each other with large area and high durability, resulting in smaller loss of transmission of vibration between the diaphragm body 10 and the voice coil 20, enabling reliable transmission of vibration between the diaphragm body 10 and the voice coil 20. Moreover, the same component as used in the common dynamic speakers may be used as the actuator 2 in the speaker 100 according to the present embodiment, resulting in lower manufacturing cost.

In the riffell speakers, in general, the stiffness of the diaphragm body 10 is different in the directions directed from the center to the periphery of the diaphragm body 10. Thus, when the diaphragm body 10 is vibrated at a particular frequency, divided vibration in a vibrating mode specific to the diaphragm body 10 is generated, and the dust cap 62 and the tubular portion 13 are deformed by the divided vibration. When the tubular portion 13 is deformed, an excessive load is imposed on the voice coil 20 coupled to the tubular portion 13, so that the voice coil 20 is also deformed. The magnetic characteristics of the actuator 2 vary due to the deformation of the voice coil 20, causing harmonic distortion.

In the speaker 100 according to the present embodiment, in contrast, the rib 62*b* extending in the direction in which the stiffness of the diaphragm body 10 is low (i.e., the direction orthogonal to the direction in which the valley 16 extends) is provided on the dust cap 62, whereby deformation of the dust cap 62 in this direction is reduced by the ribs 62*b*. That is, the rib 62*b* extending in the direction orthogonal to the direction in which the valley 16 extends acts as reinforcements for reinforcing the dust cap 62 so as not to cause deformation of the dust cap 62 due to the divided vibration that is generated in the diaphragm body 10 when the diaphragm body 10 is vibrated at the particular frequency. This is the reason why the rib 62*b* extending in the direction in which the stiffness of the diaphragm body 10 is low (i.e., the direction orthogonal to the direction in which the valley 16 extends) is provided on the dust cap 62. While the rib 62*b* extending in the direction in which the valley 16 extends also acts as the above-described reinforcements, the reinforcing effect of this rib 62*b* is less than that of the rib 62*b* extending in the direction orthogonal to the direction in which the valley 16 extends.

The speaker 100 according to the present embodiment reduces (i) the deformation of the dust cap 62 due to the divided vibration of the diaphragm body 10 and (ii) the deformation of the tubular portion 13 and the deformation of the voice coil 20 coupled to the tubular portion 13. Thus, the speaker 100 according to the present embodiment reduces the harmonic distortion due to the deformation of the voice coil 20. The description above is a reason why the harmonic distortion is reduced in the speaker 100 according to the present embodiment. Thus, the speaker 100 according to the present embodiment can achieve the wide directivity from the low frequency range to the high frequency range by using the diaphragm of the riffell type and reduce the harmonic distortion regardless of the shape of the voice coil.

It is noted that the grooves 62*a* extending along the respective ribs 62*b* provided on the back surface of the dust cap 62 are formed for the following two reasons. The first reason is canceling out an increase in the mass of the dust cap 62 due to forming of the rib 62*b*. The increase in the mass of the dust cap 62 increases the mass of the entire diaphragm 1, causing a malfunction such as requirement of more electric power for driving. The first reason why the surface of the dust cap 62 has the grooves 62*a* extending along the respective ribs 62*b* on the back surface is to avoid an occurrence of this malfunction. The second reason is securing a vibration surface for achieving the wide directivity. The groove 62*a* extending in the direction in which the valley 16 extends is formed principally for this reason.

While the embodiment has been described above, it is to be understood that the disclosure is not limited to the details of the illustrated embodiment, but may be embodied with various changes and modifications, which may occur to those skilled in the art, without departing from the spirit and scope of the disclosure.

(1) In the above-described embodiment, the present disclosure is applied to the speaker including the diaphragm of the riffell type. However, the present disclosure may be applied to any speaker as long as the speaker includes a diaphragm body having stiffness that is different in a direction directed from the center to a periphery of the diaphragm body. Specifically, the present disclosure may be applied to a speaker including a diaphragm of an oval shape or a track shape in the case where the diaphragm is seen in elevational view. The speaker including the diaphragm of an oval shape or a track shape is in most cases used for devices, such as a television receiver, in which a region for placement of the speaker is limited to a long and narrow region. The diaphragm of an oval shape or a track shape is the same as the diaphragm of the riffell speaker in that the stiffness is different in the direction directed from the center to the periphery of the diaphragm body. In the case of the diaphragm of an oval shape, for example, the stiffness of a portion of the diaphragm in the major axis direction (i.e., the stiffness of a portion of the diaphragm which extends from the center to the periphery of the diaphragm in the major axis direction) is in general less than the stiffness of a portion of the diaphragm in the minor axis direction (i.e., the stiffness of a portion of the diaphragm which extends from the center to the periphery of the diaphragm in the minor axis direction). Thus, the stiffness of the diaphragm is greater in the minor axis direction than in the major axis direction. That is, when a force is applied to the diaphragm, distortion occurs more easily in the minor axis direction than in the major axis direction, and harmonic distortion due to divided vibration of the diaphragm may occur also in the speaker including the diaphragm of this type. However, it is possible to reduce the harmonic by providing the rib extending in the major axis direction of the diaphragm (in other words, the rib extending in the direction orthogonal to the minor axis direction), on the dust cap of the speaker including the diaphragm of an oval shape.

(2) In the above-described embodiment, the ribs 62*b* for reinforcing the dust cap 62 are provided on the back surface of the dust cap 62, and the surface of the dust cap 62 has the grooves 62*a* that extend along the respective ribs 62*b* provided on the back surface, in order to avoid increase in mass due to forming of the ribs 62*b* and secure the vibration surface. However, the diaphragm of an oval shape or the diaphragm of the track type may include ribs provided on the front surface of the dust cap and grooves formed in the back surface of the dust cap. This is because there is no need of consideration of securing the vibration surface in the diaphragm of an oval shape and the diaphragm of the track type. In the above-described embodiment, the two ribs 62*b* orthogonal to each other are formed in the back surface of the dust cap 62, and the dust cap 62 is coupled to the diaphragm body 10 such that one of the two ribs 62*b* extends in the direction in which the stiffness of the diaphragm body 10 is low (i.e., the direction orthogonal to the direction in which the stiffness of the diaphragm body 10 is high). However, the speaker may be configured such that only one rib 62*b* is formed on the dust cap 62, and the dust cap 62 is coupled to the diaphragm body 10 such that the rib 62*b* extends in a direction intersecting the direction in which the stiffness of the diaphragm body 10 is high (preferably in a direction orthogonal to the direction in which the stiffness of the diaphragm body 10 is high). This is because, even in the case where the rib 62*b* extending in the direction in which the stiffness of the diaphragm body 10 is high is provided on the dust cap 62, as described above, the reinforcing effect obtained by this construction is low. Alternatively, the speaker may be configured such that three or more ribs 62*b* respectively extending in different directions are provided on the dust cap 62, and the dust cap 62 is coupled to the diaphragm body 10 such that any of the ribs 62*b* extends in a direction intersecting the direction in which the stiffness of the diaphragm body 10 is high. With these configurations, it is also possible to reduce harmonic distortion due to the divided vibration of the diaphragm body 10.

Figure 7:
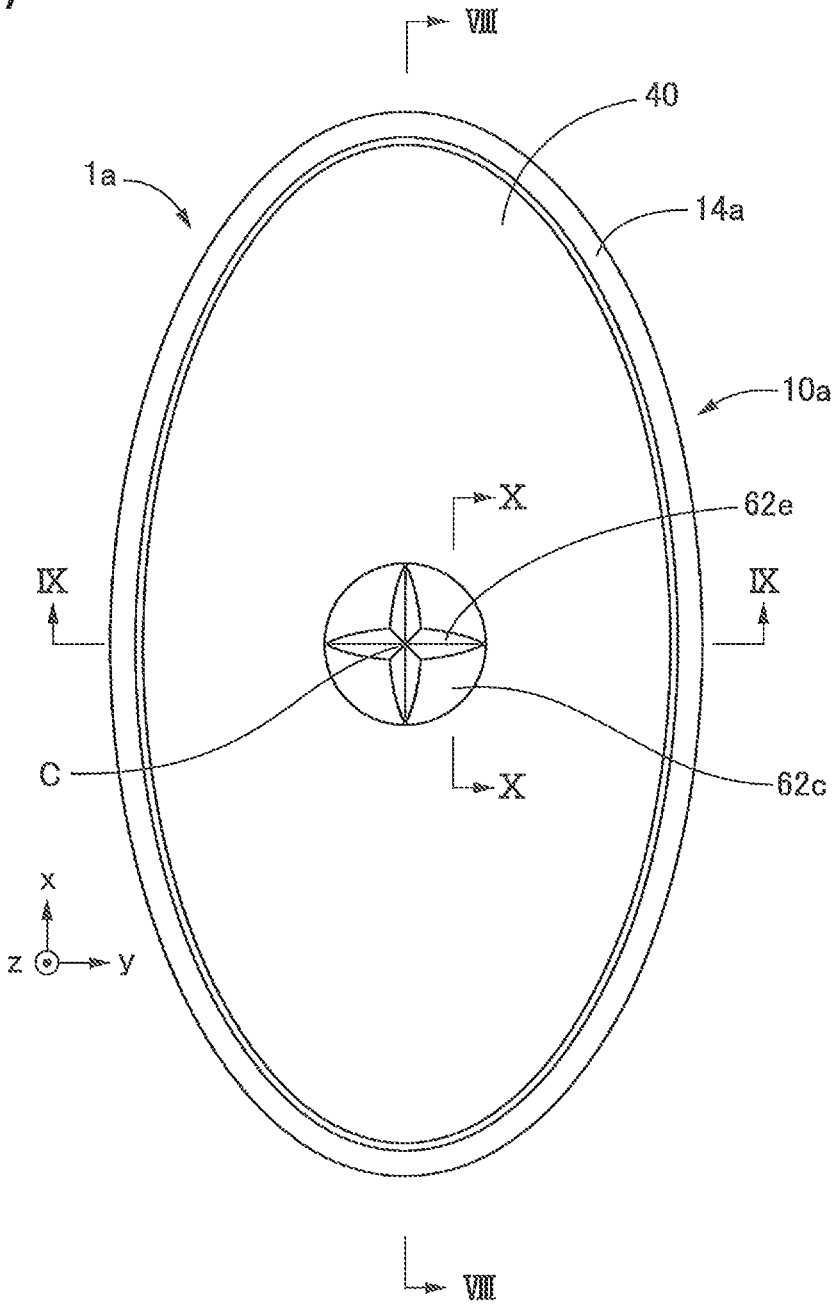
FIG. 7 is a front elevational view of a diaphragm body 10*a* in a first modification.
Figure 8:
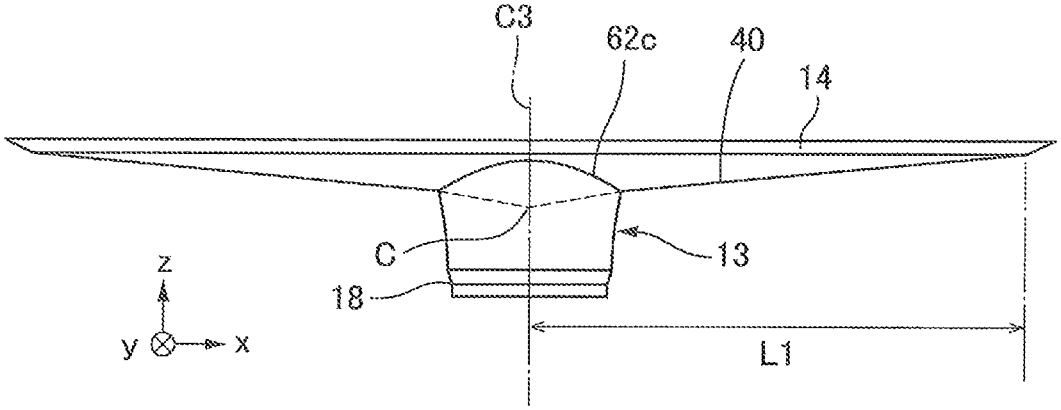
FIG. 8 is a cross-sectional view of the diaphragm body 10*a*, taken along line VIII-VIII in FIG. 7.
Figure 9:
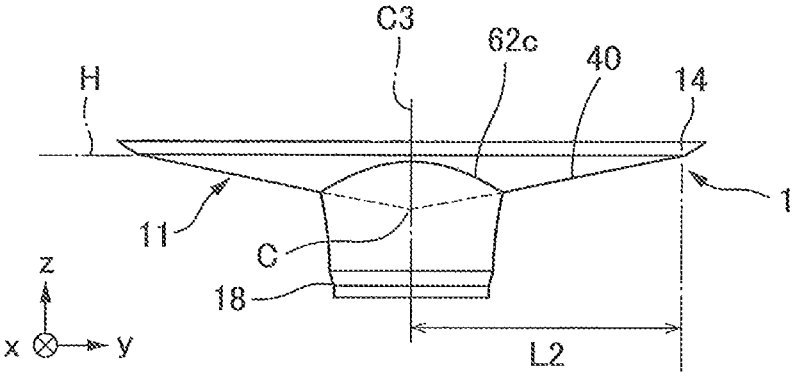
FIG. 9 is a cross-sectional view of the diaphragm body 10*a*, taken along line IX-IX in FIG. 7.
Figure 10:
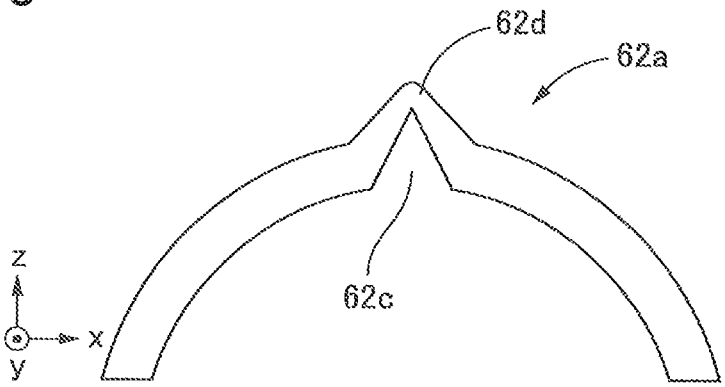
FIG. 10 is a cross-sectional view of a dust cap 62*c*, taken along line X-X in FIG. 7.

There will be described first to third modifications relating to the above-described (1) and (2). As illustrated in FIG. 7, a diaphragm 1*a* according to a first modification includes a diaphragm body 10*a* and a dust cap 62*c*. The diaphragm body 10*a* is formed such that its outer circumferential edge has an oval shape in elevational view. A vibrating portion 40 having a vibration surface of the diaphragm body 10*a* extends straight on the xz plane as illustrated in FIG. 8 and extends straight on the yz plane as illustrated in FIG. 9. In elevational view of the diaphragm body 10*a*, a central portion of the vibrating portion 40 has a through hole extending through the vibrating portion 40 in the z direction, and the dust cap 62*c* is provided so as to close this through hole. The vibrating portion 40 is bonded to an outer surface of the dust cap 62*c*. The dust cap 62*c* is a substantially-flat dome-shaped member having substantially the same diameter as that of the through hole formed in the vibrating portion 40. Unlike the dust cap 62, however, as illustrated in FIG. 10, two grooves 62*d* are formed on an inner-circumferential-surface side (i.e., a back-surface side) of the dome shape. The grooves 62*d* are orthogonal to each other in elevational view of the dust cap 62*c*. As illustrated in FIG. 7, two ribs 62*e* are provided on an outer circumferential surface (i.e., a front surface) of the dust cap 62*c* so as to be orthogonal to each other. Each of the two ribs 62*e* extends along a corresponding one of the two grooves 62*d* across the dust cap 62*c* in a corresponding one of the diameter directions of the dust cap 62*c*. The two ribs 62*e* protrude from the front surface of the dust cap 62*c* in a direction directed from the back surface toward the front surface of the dust cap 62*c*. As illustrated in FIG. 8, the tubular portion 13 is provided under the vibrating portion 40. As illustrated in FIG. 7, an oval ring plate 14*a* for connecting the vibrating portion 40 to the edge member 4 is provided on an outer circumferential edge of the vibrating portion 40. It is noted that the vibrating portion 40, the tubular portion 13, the ring plate 14*a*, and the dust cap 62*c* are molded as one component but may be formed individually and joined to each other as one component with adhesives, for example. It is noted that, though not illustrated, the edge member 4 connectable to the oval ring plate 14*a* is formed so as to match the oval shape of the ring plate 14*a*, and the flange portion 30 and the arm portions 31 of the support frame 3 are also formed so as to match the oval shape of the diaphragm body 10*a* in elevational view. It is noted that the other construction is the same as that in the above-described embodiment.

As illustrated in FIG. 7, the oval diaphragm body 10*a* is constructed such that the size of the oval diaphragm body 10*a* in the front and rear direction (i.e., the x direction) (i.e., the length of the longer diameter or the length of the oval diaphragm body 10*a* in the major axis direction) in elevational view is greater than the size of the oval diaphragm body 10*a* in the right and left direction (i.e., the y direction) (i.e., the length of the shorter diameter or the length of the oval diaphragm body 10*a* in the minor axis direction) in elevational view. In the case where the point of intersection of the major axis and the minor axis of the diaphragm body 10*a* in elevational view is defined as the center C, as illustrated in FIGS. 8 and 9, the distance L1 between the center C and the periphery of the diaphragm body 10*a* (i.e., between the center C and the outer edge of the vibrating portion 40) in the front and rear direction (i.e., the x direction) is greater than the distance L2 between the center C to the periphery of the diaphragm body 10*a* in the right and left direction (i.e., the y direction). Accordingly, the stiffness of the diaphragm body 10*a* is different in the direction directed from the center C toward the periphery of the diaphragm body 10*a*. Specifically, the stiffness of a portion of the diaphragm body 10*a* (hereinafter may be referred to as "major-axis portion") which extends from the center C to the periphery of the diaphragm body 10*a* along the front and rear direction (i.e., the major axis direction) is less than the stiffness of a portion of the diaphragm body 10*a* (hereinafter may be referred to as "minor-axis portion") which extends from the center C to the periphery of the diaphragm body 10*a* along the right and left direction (i.e., the minor axis direction). Since the stiffness of the diaphragm body 10*a* is different in the directions directed from the center to the periphery of the diaphragm body 10*a*, when the diaphragm body 10*a* is vibrated, divided vibration in a vibrating mode specific to the diaphragm body 10*a* is generated at the particular frequency. Since the stiffness of the minor-axis portion is greater than that of the major-axis portion as described above, when the diaphragm body 10*a* is vibrated, the minor-axis portion is deformed greatly in a direction of the vibration while applying a large force to the tubular portion 13 of the diaphragm body 10*a*. Since the stiffness of the major-axis portion is low, the force applied from the major-axis portion to the tubular portion 13 of the diaphragm body 10*a* is not large, and an amount of displacement of the major-axis portion in the direction of the vibration is small. Accordingly, when the diaphragm body 10*a* is vibrated, the minor-axis portion is deformed by a larger amount in the direction of the vibration than the major-axis portion. Thus, the stiffness of the entire diaphragm body 10*a* in the right and left direction (i.e., the minor axis direction as the one example of the second direction) is less than that of the entire diaphragm body 10*a* in the front and rear direction (i.e., the major axis direction as the one example of the first direction). That is, the stiffness of the diaphragm body 10*a* in the direction directed from the center toward the periphery of the diaphragm body 10*a* along the right and left direction (i.e., the minor axis direction) is less than that of the diaphragm body 10*a* in the direction directed from the center toward the periphery of the diaphragm body 10*a* along the front and rear direction (i.e., the major axis direction). Accordingly, a direction in which the stiffness of the diaphragm body 10*a* having an oval shape in elevational view is highest coincides with the front and rear direction (i.e., the major axis direction). Thus, since the stiffness of the diaphragm body 10*a* in the front and rear direction (i.e., the major axis direction) is greater than that of the diaphragm body 10*a* in each of the other directions, the divided vibration is generated in the diaphragm body 10*a*, which applies a force related to the divided vibration, to the dust cap 62*c* and the tubular portion 13. In the case where at least one of the two ribs 62*e* formed on the dust cap 62*c* extends in a direction intersecting the front and rear direction, it is possible to increase the stiffness of the diaphragm body 10*a* in the direction directed from the center C toward the periphery of the diaphragm body 10*a* along the right and left direction. In the present first modification, one of the two ribs 62*e* of the dust cap 62*c* extends in the right and left direction that is one of the directions intersecting the front and rear direction. This configuration in the present first modification can suppress deformation of the dust cap 62*c* due to the divided vibration of the diaphragm body 10*a*, thereby reducing distortion of the magnetic characteristics at high frequencies due to the deformation of the voice coil 20.

Figure 11:
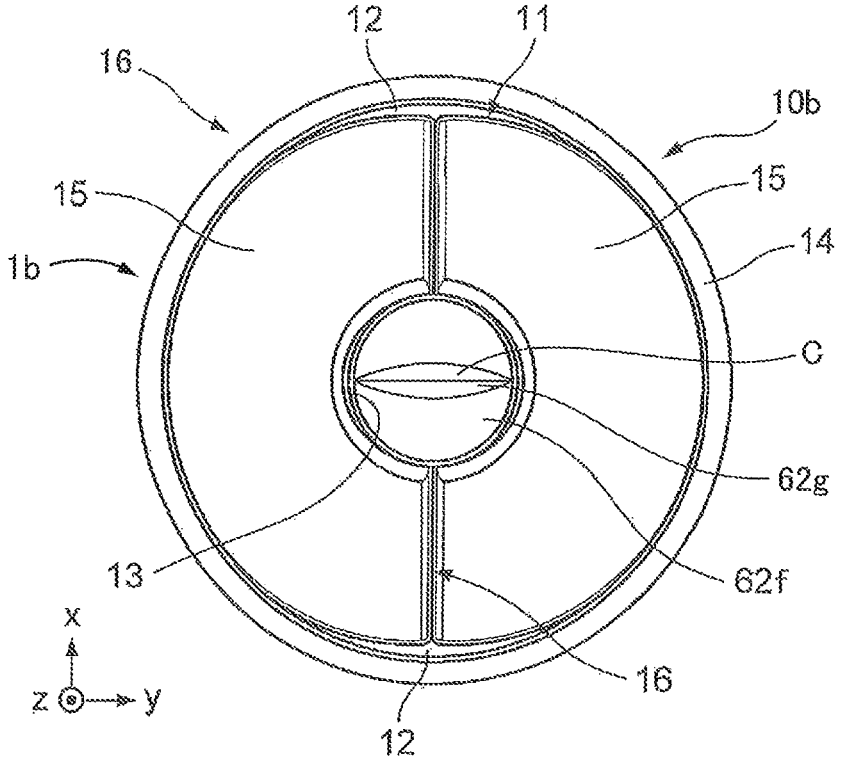
FIG. 11 is a front elevational view of a diaphragm body 10*b* in a second modification.
Figure 12:
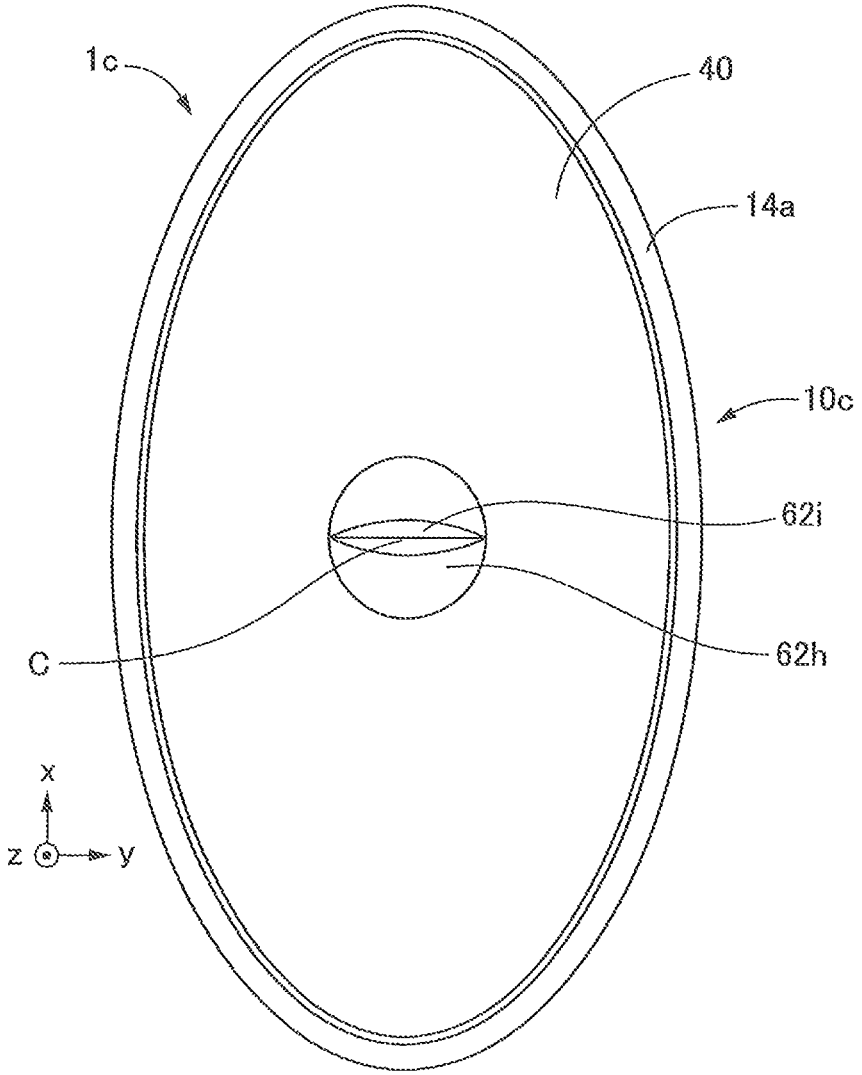
FIG. 12 is a front elevational view of a diaphragm body 10*c* in a third modification.

While the two ribs 62*b* orthogonal to each other are provided on the dust cap 62 in the above-described embodiment, the two ribs 62*b* may be replaced with a single rib. For example, as illustrated in FIG. 11, a diaphragm 1*b* according to a second modification includes a diaphragm body 10*b* and a dust cap 62*f*. The dust cap 62*f* is provided with a rib 62*g* extending in a direction directed from the center C toward the periphery of the dust cap 62*f* along the right and left direction. However, the dust cap 62*f* is not provided with a rib extending in a direction directed from the center C toward the periphery of the dust cap 62*f* along the front and rear direction. The other construction in this modification is similar to that of the diaphragm 1 according to the above-described embodiment. Also in this modification, it is possible to suppress deformation of the dust cap 62*f* due to the divided vibration of the diaphragm body 10*b*, thereby reducing distortion of the magnetic characteristics at high frequencies due to the deformation of the voice coil 20. While the two ribs 62*b* provided on the dust cap 62*c* are orthogonal to each other in the above-described first modification, these two ribs 62*b* may be replaced with a single rib. As illustrated in FIG. 12, a diaphragm 1*c* according to a third modification includes a diaphragm body 10*c* and a dust cap 62*h*. The dust cap 62*h* is provided with a rib 62*i* extending in a direction directed from the center C toward the periphery of the dust cap 62*h* along the front and rear direction. However, the dust cap 62*h* is not provided with a rib extending in a direction directed from the center C toward the periphery of the dust cap 62*h* along the right and left direction. The other construction in this modification is similar to that of the diaphragm 1*a* according to the first modification. Also in this modification, it is possible to suppress deformation of the dust cap 62*h* due to the divided vibration of the diaphragm body 10*c*, thereby reducing distortion of the magnetic characteristics at high frequencies due to the deformation of the voice coil 20.

(3) In the above-described embodiment, the diaphragm body 10 and the dust cap 62 (the protector that protects the actuator 2 from ingress of foreign matters) of the diaphragm 1 are separate members. This is for accurately manufacturing the diaphragm 1 with a simple procedure including: manufacturing the diaphragm body 10 by securing the voice coil 20 to the tubular portion 13 such that an upper end of the voice coil 20 slightly protrudes from the straight tubular portion 18; and thereafter closing the through hole 19 by joining the dust cap 62 to the upper end of the voice coil 20 (i.e., the upper end of the bobbin 20*a*). However, the diaphragm 1 may be constructed by molding the diaphragm body 10 and the dust cap 62 as one component.

(4) The diaphragm 1 according to the above-described embodiment may be provided as a single component. That is, a diaphragm including: a diaphragm body having stiffness different in a direction directed from the center to a periphery of the diaphragm body; and a protector which protects a transducer for performing conversion between vibration of the diaphragm body and an electric signal, from ingress of foreign matters and which is provided with a rib extending in a direction intersecting a direction in which the stiffness of the diaphragm body is high may be manufactured and sold as a single component.

(5) The present disclosure may be applied to a microphone unit including a voice coil connected to a diaphragm and configured to convert vibration of the diaphragm to an alternating signal and output the signal. Also in this microphone unit, in the case where the stiffness of the diaphragm is different in a direction directed from the center to a periphery of the diaphragm, the output signal contains a harmonic component caused by a difference in directions of the stiffness. However, it is possible to reduce the harmonic component by applying the present disclosure to the microphone unit. Devices to which the present disclosure may be applied is not limited to electroacoustic transducers such as a microphone unit and a speaker and may be transducers that performs conversion between vibration and an electric signal. That is, in the case where transducers include: a diaphragm body having stiffness different in a direction directed from the center to a periphery of the diaphragm body; a transducer for performing conversion between vibration of the diaphragm body and an electric signal; and a protector which protects the transducer from ingress of foreign matters and which is provided with a rib extending in a direction intersecting a direction in which the stiffness of the diaphragm body is high, the transducers can reduce harmonic distortion contained in the output signal or harmonic distortion contained in a sound radiated by driving of the diaphragm, by applying the present disclosure to the transducers.

In one aspect of the disclosure, a diaphragm for a speaker includes: a diaphragm body configured to provide different stiffness along different directions extending from a center of the diaphragm body to a periphery of the diaphragm body, with a largest stiffness value provided along a first direction extending between the center and the periphery of the diaphragm body; and a protector including a first rib extending in one of the first direction or a second direction, where the stiffness is less than the largest stiffness value, intersecting the first direction.

According to the configuration as described above, the rib is provided on the protector. This configuration reduces deformation of the protector in the direction in which the stiffness of the diaphragm body is low (i.e., the second direction). Thus, in the case where the diaphragm is used for electroacoustic transducers such as speakers and microphones, the electroacoustic transducers can reduce deformation of a voice coil coupled to the protector and configured to convert deformation of the diaphragm and an electric signal, which deformation of the voice coil is caused due to difference in directions of the stiffness of the diaphragm. That is, the electroacoustic transducer using the diaphragm according to the present aspect suppresses deformation of the voice coil due to difference in the stiffness of the diaphragm body in the direction directed from the center to the periphery of the diaphragm body, thereby reducing harmonic distortion due to the deformation of the voice coil. It should be noted that there is no particular limitation for the shape of a coil (e.g., a voice coil in the case of the speakers or the microphones) coupled to the diaphragm for performing conversion between the vibration and the electric signal. Accordingly, the harmonic distortion can be reduced in the electroacoustic transducer including the diaphragm with the stiffness different in the direction directed from the center to the periphery of the diaphragm body.

In the diaphragm, the diaphragm body and the protector are arranged so that a position of the center of the diaphragm body and a position of a center of the protector are located at a first position. The first rib extends through the first position along the second direction.

According to the configuration as described above, the effect of reducing the deformation of the protector is highest.

In the diaphragm, the first rib extends in the second direction, and the protector includes a second rib extending in a direction intersecting the second direction in which the first rib extends.

In the diaphragm, the second rib extends in the first direction.

In the diaphragm, the first rib extends in the first direction.

In the diaphragm, a pair of longitudinal split tubular surfaces are formed side by side on the diaphragm body. The diaphragm body includes; a wing-pair portion forming a valley between side portions of the respective longitudinal split tubular surfaces; an end plate that closes opposite ends of the valley formed in the wing-pair portion; a tubular portion formed at an intermediate portion of the valley in a direction in which the valley extends, the tubular portion extending in a depth direction of the valley and being configured to couple a bobbin for a coil that performs conversion between vibration of the diaphragm body and an electric signal; and a through hole communicating with the tubular portion. The protector is configured to be joined to the bobbin to cover the through hole.

According to the configuration as described above, it is possible to reduce harmonic distortion while achieving wide directivity from low frequencies to high frequencies.

In the diaphragm, the first direction is substantially parallel to the direction in which the valley extends.

In the diaphragm, the first rib extends in the second direction, which is substantially orthogonal to the direction in which the valley extends.

In the diaphragm, the first rib extends in the second direction. A first distance in the first direction between the center of the diaphragm body and the periphery of the diaphragm body is less than a second distance in the second direction between the center of the diaphragm body and the periphery of the diaphragm body.

In the diaphragm, the diaphragm body and the protector are molded as one component.

According to the configuration as described above, it is possible to easily manufacture the diaphragm according to the present disclosure, using vacuum forming or the press forming, for example.

In the diaphragm, the diaphragm body is secured to an outer portion of the protector.

In the diaphragm, the diaphragm body includes: a wing-pair portion forming a valley; a tubular portion formed at an intermediate portion of the valley in a direction in which the valley extends, the tubular portion extending in a depth direction of the valley; and a through hole extending through the tubular portion. The protector is disposed at a position covering the through hole.

In the diaphragm, the first rib extends in the second direction, which intersects the direction in which the valley extends.

In the diaphragm, the protector includes a groove extending along the first rib.

Another aspect of the disclosure relates to an electroacoustic transducer including the above-described diaphragm.

According to the configuration as described above, it is possible to reduce the harmonic distortion.

What is claimed is:

1. A diaphragm for a speaker, the diaphragm comprising:

a diaphragm body configured to provide different stiffness along different directions extending from a center of the diaphragm body to a periphery of the diaphragm body, and including:

a wing-pair portion forming a valley extending along a valley direction;

a tubular portion formed at an intermediate portion of the valley in the valley direction, the tubular portion extending in a depth direction of the valley; and a through hole extending through the tubular portion, wherein a largest stiffness of the diaphragm body is provided along the valley direction; and a protector disposed at a position covering the through hole, and including:

a first rib extending in a parallel direction parallel to the valley direction and includes a first valley that extends an entire length of the first rib; and a second rib extending in an orthogonal direction orthogonal to the valley direction and includes a second valley that extends an entire length of the second rib, wherein each of the first rib and the second rib extends through a center of the protector as viewed in an elevational view.

2. The diaphragm according to claim 1, wherein:

the diaphragm body and the protector are arranged so that a position of the center of the diaphragm body and a position of the center of the protector are located at a first position, and the first rib extends through the first position along the orthogonal direction.

3. The diaphragm according to claim 1, further including:

a pair of longitudinal split tubular surfaces formed side by side on the diaphragm body, wherein the diaphragm body further includes an end plate that closes opposite ends of the valley formed in the wing-pair portion, wherein the wing-pair portion forms the valley between side portions of the respective longitudinal split tubular surfaces, wherein the tubular portion is configured to couple a bobbin for a coil that performs conversion between vibration of the diaphragm body and an electric signal, wherein the through hole communicates with the tubular portion, and wherein the protector is configured to be joined to the bobbin to cover the through hole.

4. The diaphragm according to claim 1, wherein the diaphragm body and the protector are molded as one component.

5. The diaphragm according to claim 1, wherein the diaphragm body is secured to an outer portion of the protector.

6. The diaphragm according to claim 1, wherein the protector includes a groove extending along the first rib.

7. An electroacoustic transducer comprising:

a coil; and a diaphragm comprising:

a diaphragm body configured to provide different stiffness along different directions extending from a center of the diaphragm body to a periphery of the diaphragm body, and including:

a wing-pair portion forming a valley extending along a valley direction;

a tubular portion formed at an intermediate portion of the valley in the valley direction, the tubular portion extending in a depth direction of the valley; and a through hole extending through the tubular portion, wherein a largest stiffness of the diaphragm body is provided along the valley direction; and a protector disposed at a position covering the through hole, and including:

a first rib extending in an orthogonal direction orthogonal to the valley direction and includes a first valley that extends an entire length of the first rib; and a second rib extending in a parallel direction parallel to the valley direction and includes a second valley that extends an entire length of the second rib, wherein each of the first rib and the second rib extends through a center of the protector viewed from an elevational view.

8. A diaphragm for a speaker, the diaphragm comprising:

an oval-shaped diaphragm body configured to provide different stiffness along different directions extending from a center of the oval-shaped diaphragm body to a periphery of the oval-shaped diaphragm body, wherein a largest stiffness of the oval-shaped diaphragm body is provided along a direction orthogonal to a major axis direction of the oval-shaped diaphragm body; and a protector including only a first single rib extending through the center in the direction orthogonal to the major axis direction.

9. A diaphragm for a speaker, the diaphragm comprising:

an oval-shaped diaphragm body configured to provide different stiffness along different directions extending from a center of the oval-shaped diaphragm body to a periphery of the oval-shaped diaphragm body; and a protector including:

a first rib extending through the center in a direction orthogonal to a major axis direction of the oval-shaped diaphragm and includes a first valley that extends an entire length of the first rib; and a second rib extending through the center in a direction parallel to the major axis direction and includes a second valley that extends an entire length of the second rib.

* * * * *